US009119235B2

(12) United States Patent
Cao

(10) Patent No.: US 9,119,235 B2
(45) Date of Patent: Aug. 25, 2015

(54) LED BACKLIGHT SOURCE AND LIQUID CRYSTAL DISPLAY DEVICE

(71) Applicant: Shenzhen China Star Optoelectronics Technology Co., Ltd., Shenzhen, Guangdong (CN)

(72) Inventor: Dan Cao, Guangdong (CN)

(73) Assignee: Shenzhen China Star Optoeletronics Technology Co., Ltd, Shenzhen, Guangdong (CN)

( * ) Notice: Subject to any disclaimer, the term of this patent is extended or adjusted under 35 U.S.C. 154(b) by 85 days.

(21) Appl. No.: 14/005,229

(22) PCT Filed: Jun. 25, 2013

(86) PCT No.: PCT/CN2013/077913

§ 371 (c)(1),
(2) Date: Sep. 13, 2013

(87) PCT Pub. No.: WO2014/180034

PCT Pub. Date: Nov. 13, 2014

(65) Prior Publication Data

US 2014/0327860 A1 Nov. 6, 2014

(51) Int. Cl.

| | |
|---|---|
| ***H05B 37/02*** | (2006.01) |
| ***H05B 33/00*** | (2006.01) |
| ***G09G 3/34*** | (2006.01) |

(52) U.S. Cl.

CPC ..... *H05B 33/00* (2013.01); *G09G 3/3426* (2013.01); *G09G 2310/0291* (2013.01); *G09G 2330/02* (2013.01); *G09G 2330/08* (2013.01)

(58) Field of Classification Search

CPC ..... H05B 33/00; H05B 37/00; H05B 37/02; H05B 37/032; G09G 3/3426; G09G 2310/0291; G09G 2330/02; G09G 2330/08

USPC ..... 315/169.1–169.3, 209 R, 210, 291, 307, 315/308, 312, 185 R, 192, 193

See application file for complete search history.

(56) References Cited

U.S. PATENT DOCUMENTS

| | | | | |
|---|---|---|---|---|
| 8,334,662 | B2 * | 12/2012 | Jin et al. | 315/299 |
| 8,368,322 | B2 * | 2/2013 | Yu et al. | 315/306 |
| 2010/0328370 | A1 * | 12/2010 | Takata et al. | 345/694 |

FOREIGN PATENT DOCUMENTS

| | | | |
|---|---|---|---|
| CN | 102076139 | A | 5/2011 |
| TW | 201248596 | A | 12/2012 |

* cited by examiner

*Primary Examiner* — Jimmy Vu
(74) *Attorney, Agent, or Firm* — Andrew C. Cheng

(57) ABSTRACT

The invention provides LED backlight source, including: a boost converter, for boosting input voltage and outputting boosted voltage; N parallel LED strings, wherein each LED string including a plurality of series LEDs and receiving boosted voltage; a backlight driving IC, for controlling connection/disconnection of boost converter and determining whether to shut down LED strings other than specific LED string based on voltage at negative terminal of specific LED string; and N control circuits, wherein each control circuit controlling voltage at negative terminal of corresponding LED string not to become zero so that backlight driving IC unable to shut down LED strings other than corresponding LED string. When an LED string becomes open, backlight driving IC cannot shut down LEDs strings other than the open LED string to avoid turning off all LED strings. The invention also provides liquid crystal display with LED backlight source.

16 Claims, 3 Drawing Sheets

LED BACKLIGHT SOURCE AND LIQUID CRYSTAL DISPLAY DEVICE

BACKGROUND OF THE INVENTION

1. Field of the Invention

The present invention relates to the field of liquid crystal displaying techniques, and in particular to an LED backlight source and liquid crystal display device.

2. The Related Arts

As the technology continuously progresses, the development of backlight technology of liquid crystal display device also continuously grows. The conventional backlight technology of liquid crystal display device uses cold cathode fluorescent lamp (CCFL). But as CCFL backlight has the disadvantages of poor color recovery, low light-emitting efficiency, high discharge voltage, poor discharge characteristics at low temperature, long time to reach stable grayscale, and so on, the backlight technology employing LED has been developed.

In liquid crystal display device, the LED backlight source and the liquid crystal display panel are disposed oppositely face-to-face so that the LED backlight source provides light source to the liquid crystal display panel, wherein the LED backlight source comprises a plurality of LED strings, with each LED string comprising a plurality of LEDs strung in series. To drive each LED string, a dedicated driving circuit must be used to supply driving voltage to the LED string.

FIG. 1 is a schematic view showing an LED backlight source of a known technology used in liquid crystal display devices. As shown in FIG. 1, the backlight driver includes a boost converter 110, a plurality of LED strings 120 connected in parallel and a plurality of backlight driving IC 130.

The boost converter 110 is to boost the input DC voltage to satisfy the requirements of the LED strings. The backlight driving IC 130 controls the connection/disconnection of the boost converter 110 and determines whether to shut down the LED strings other than any specific LED string based on the voltage over a resistor R1 of the specific LED string (i.e., the voltage at the negative terminals of a plurality of series LEDs of the specific LED).

When any LED string is shut down, the current of the LED string is zero and the voltage at the negative terminal of the LEDs of the LED string becomes zero. When the backlight driving IC 130 detects the voltages at the negative terminals of the LEDs of any LED string are zero, the backlight driving IC 130 will control to shut down all the LED strings other than the specific LED string so that the plurality of LED strings 120 is all shut down and turned off, which leads to the LED backlight source unable to supply display light source to the liquid crystal display panel and affecting the liquid crystal displaying quality.

SUMMARY OF THE INVENTION

To address the above issues in known technologies, the present invention provides an LED backlight source applicable to liquid crystal display device, which comprises: a boost converter, for boosting the input DC voltage and outputting boosted DC voltage; N LED strings connected in parallel, wherein each LED string comprising a plurality of LEDs strung in series and receiving the boosted DC voltage from the boost converter, N being a natural number; a backlight driving IC, for controlling the connection/disconnection of the boost converter, and determining whether to shut down the LED strings other than a specific LED string based on the voltage at the negative terminal of the specific LED string; and N control circuits, wherein each control circuit controlling the voltage at negative terminal of a corresponding LED string not to become zero so that the backlight driving IC unable to shut down LED strings other than the corresponding LED string.

The present invention provides a liquid crystal display device, which comprises: a liquid crystal display panel and an LED backlight source disposed opposite to the liquid crystal display panel, the LED backlight source providing display light source to the liquid crystal display panel for the liquid crystal panel to display images, wherein the LED backlight source further comprising: a boost converter, for boosting the input DC voltage and outputting boosted DC voltage; N LED strings connected in parallel, wherein each LED string comprising a plurality of LEDs strung in series and receiving the boosted DC voltage from the boost converter, N being a natural number; a backlight driving IC, for controlling the connection/disconnection of the boost converter, and determining whether to shut down the LED strings other than a specific LED string based on the voltage at the negative terminal of the specific LED string; and N control circuits, wherein each control circuit controlling the voltage at negative terminal of a corresponding LED string not to become zero so that the backlight driving IC unable to shut down LED strings other than the corresponding LED string.

According to a preferred embodiment of the present invention, the control circuit further comprises: an open detection unit, for detecting whether a corresponding LED string being open; and an open trigger protection unit, for controlling the negative terminal of a corresponding LED string not to become zero when the open detection unit detecting the corresponding LED string being open.

According to a preferred embodiment of the present invention, the negative terminals of the plurality of LED strings are connected to the drain of a first MOS transistor and connected to the open trigger protection unit, the source of the first MOS transistor is connected to one end of a first resistor and connected to the backlight driving IC, one end of the first resistor is connected to the open detection unit and the other end of the first resistor is ground, and the gate of the first MOS transistor is connected to the backlight driving IC.

According to a preferred embodiment of the present invention, the open detection unit comprises a first operational amplifier, the open trigger protection unit comprises a second MOS transistor and a backup circuit, wherein the first operational amplifier has a negative terminal connected to one end of the first resistor, a positive terminal grounded and an output terminal connected to the gate of the second MOS transistor; the source of the second MOS transistor is connected to the drain of the first MOS transistor; one end of the backup circuit is connected to the positive terminals of the plurality of LED strings and the other end of the backup circuit is connected to the drain of the second MOS transistor.

According to a preferred embodiment of the present invention, the backup circuit comprises a resistor, wherein one end of the resistor is connected to the positive terminals of the plurality of LED strings and the other end of the resistor is connected to the drain of the second MOS transistor.

According to a preferred embodiment of the present invention, the backup circuit comprises at least two resistors, wherein one end of each resistor is connected to the positive terminals of the plurality of LED strings and the other end of each resistor is connected to the drain of the second MOS transistor.

According to a preferred embodiment of the present invention, the open detection unit comprises a second operational amplifier and the open trigger protection unit comprises a third MOS transistor, wherein in each control circuit, the second operational amplifier has a positive terminal grounded and an output terminal connected to the gate of the third MOS transistor; the source of the third MOS transistor is connected to the drain of the first MOS transistor of the first LED string; in the first control circuit, the negative terminal of the second operational amplifier is connected to the source of the first MOS transistor of the first LED string, the source of the third MOS transistor is connected to the drain of the first MOS transistor of the second LED string; in the second to N-th control circuits, the negative terminal of the second operational amplifier is connected respectively to the source of the first MOS transistor of the second to N-th LED string, the source of the third MOS transistor is connected respectively to the drain of the first MOS transistor of the second to N-th LED string.

According to a preferred embodiment of the present invention, the boost converter comprises an inductor, a rectifier diode and a fourth MOS transistor, wherein one end of the inductor is connected to the input DC voltage and the other end of the inductor is connected to the drain of the fourth MOS transistor; the gate of the fourth MOS transistor is connected to the backlight driving IC; and the negative terminal of the rectifier diode is connected to the positive terminals of the plurality of LED strings.

According to a preferred embodiment of the present invention, the LED backlight source further comprises a fifth resistor, with one end connected to the source of the fourth MOS transistor and the other end grounded.

In the LED backlight source and the liquid crystal display device of the present invention, when any specific LED string of a plurality of parallel LED strings is open, the backlight driving IC will not shut down the LED strings other than the specific LED string to prevent all the plurality of parallel LED strings from turning off at the same time so that the LED backlight source can continue to provide display light source to the liquid crystal display panel so that the liquid crystal display panel can display images.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
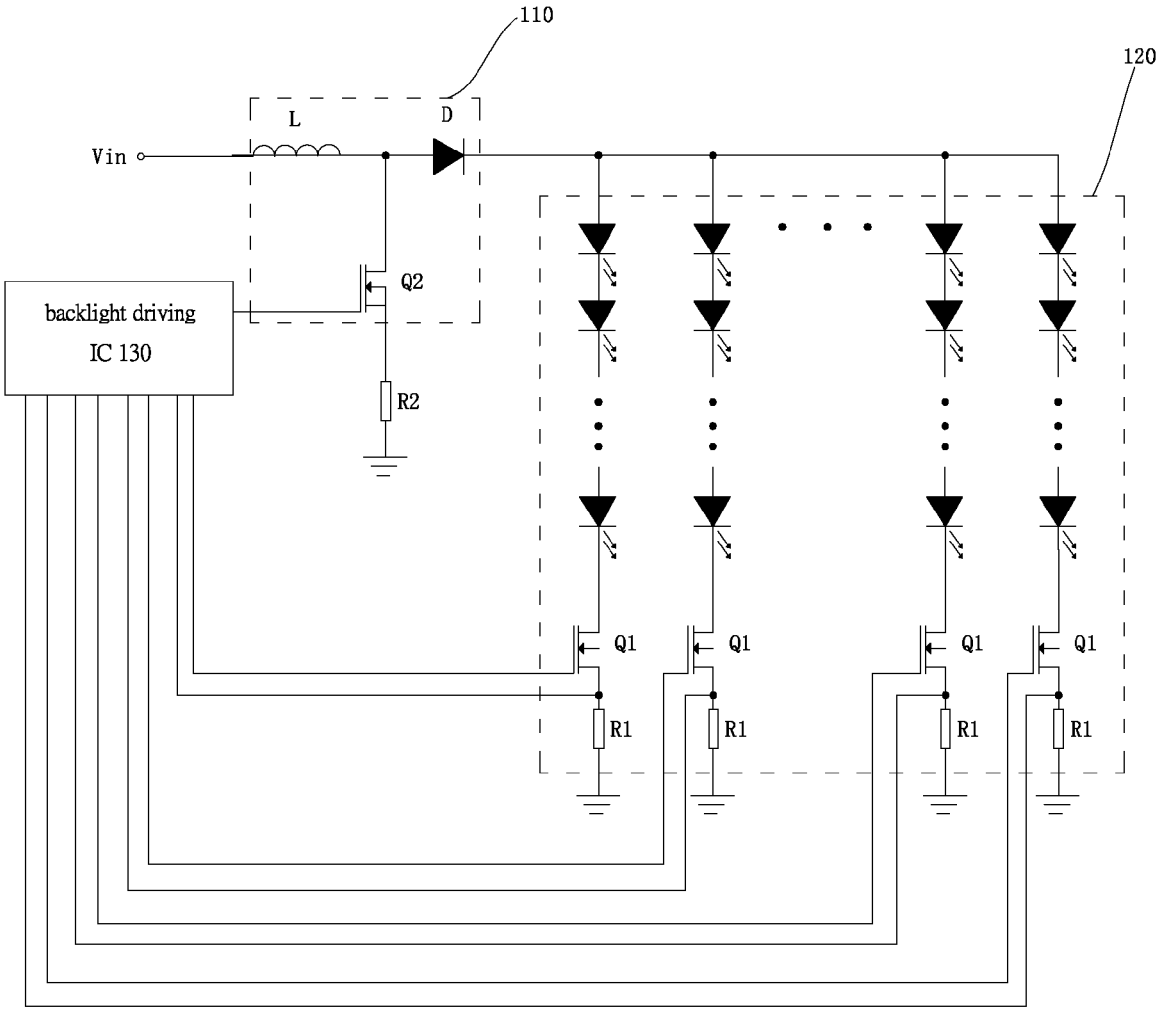
FIG. 1 is a schematic view showing the LED backlight source of a known liquid crystal display device.

The following describes the embodiments of the present invention in details. The embodiments are depicted in the drawings, wherein the same number indicates the same part. The following refers to the drawings and embodiments for detailed description of the present invention. In the following, to prevent the unnecessary details of commonly known structures and/or functions from cluttering the concept of the present invention, the details of commonly known structures and/or functions are omitted.

First Embodiment

Figure 2:
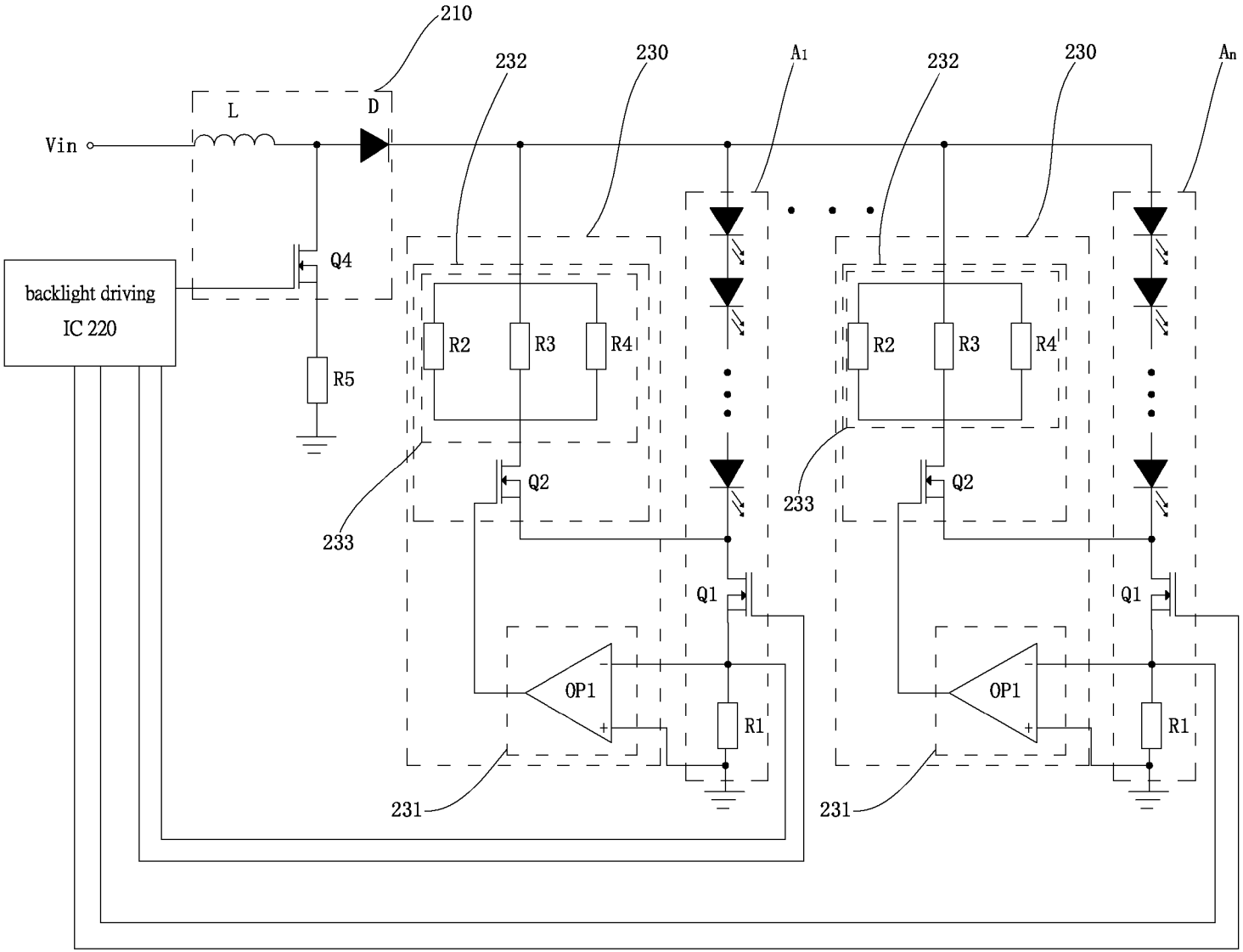
FIG. 2 is a schematic view showing the LED backlight source of liquid crystal display device according to the first embodiment of the present invention.

FIG. 2 is a schematic view showing the LED backlight source of liquid crystal display device according to the first embodiment of the present invention.

As shown in FIG. 2, according to the present invention, the embodiment of the LED backlight source of liquid crystal display device is disposed opposite to the liquid crystal display panel. The LED backlight source provides display light source to the liquid crystal display panel so that the liquid crystal display panel can display images. The LED backlight source comprises a boost converter 210, N LED strings, A1, A2, . . . , An, connected in parallel, a backlight driving IC 220 and N control circuits, wherein N is an integer greater than 0.

The boost converter 210 is for boosting the input DC voltage Vin and outputting boosted DC voltage.

The N LED strings, A, A2, . . . , An, are for providing display light source to the liquid crystal display panel. Each LED string comprises a plurality of LEDs, all strung in series. The N LED strings, A1, A2, . . . , An, receive boosted DC voltage from the boost converter 210.

The number of the LEDs in each LED string is M (M is an integer and M>0) can be determined by the following:

$$N \times Vd \leq Vs$$

Wherein Vd is the light-emitting voltage of each LED and Vs is the output voltage of the boost converter 210.

For example, when Vd is 6.5V, Vs=48V, the N is determined to be less than or equal to 7 (N≤7).

The backlight driving IC 220 is for controlling the connection and/or disconnection of the boost converter 210, and determining whether to shut down the LED strings other than a specific LED string based on whether the voltages at the negative terminals of the plurality of LEDs of the specific LED string becoming zero. For example, when the first LED string A1 becomes open, the backlight driving IC 220 detects the voltages at the negative terminals of the plurality of LEDs of the LED string A1 becoming zero and then controls to shut down all the N parallel LED strings A1, A2, . . . , An.

Each of the N control circuits 230 controls the voltage at negative terminal of a corresponding LED string not to become zero so that the backlight driving IC 220 is unable to shut down LED strings other than the corresponding LED string so as to prevent all N parallel N LED strings from becoming turned off at the same time. For example, when the first LED string A1 becomes open, the corresponding control circuit 230 controls the voltage at negative terminals of the plurality of LEDs of the first LED string A1 not to become zero so that the backlight driving IC 220 detects the voltages at the negative terminals of the plurality of LEDs of the LED string A1 not being zero and will not shut down LED strings other than the first LED string A1 so as to prevent all N parallel N LED strings from becoming turned off at the same time.

In addition, each of the N control circuits 230 further comprises an open detection unit 231 and an open trigger protection unit 232. The open detection unit 231 detects whether a corresponding LED string being open. When the open detection unit 231 detects the corresponding LED string is open, the open trigger protection unit 232 controls the negative terminals of the plurality of LEDs of the corresponding LED string not to become zero. As such, the backlight driving IC 220 will not shut down LED strings other than the corresponding LED string so as to prevent all N parallel N LED strings from becoming turned off at the same time. For example, when the first LED string A1 becomes open, the corresponding open detection unit 231 detects that the first LED string A1 has become open; at this point, the corresponding open trigger protection unit 232 controls the voltage at negative terminals of the plurality of LEDs of the first LED string A1 not to become zero so that the backlight driving IC 220 detects the voltages at the negative terminals of the plurality of LEDs of the LED string A1 not being zero and will not shut down LED strings other than the first LED string A1.

Furthermore, to prevent the current of each LED string from over-current and damaging the LEDs of the LED string, a first resistor R1 is connected in series to the negative terminal of the plurality of the LEDs of the LED string. It should be noted that the voltage at the negative terminal of the plurality of the LEDs of the LED string is the voltage across the two ends of the first resistor R1. In addition, a MOS transistor Q1 is connected between the negative terminal of the plurality of LEDs of the LED string and the first resistor. Specifically, the drain of the first transistor Q1 is connected to the negative terminal of the plurality of LEDs of each LED string, the source of the MOS transistor Q1 is connected to one end of the first resistor R1 and the other end of the first resistor R1 is grounded, and the gate of the MOS transistor Q1 is connected to the backlight driving IC 220. The backlight driving IC 220, through controlling the state of the MOS transistor Q1, controls the current in each LED string.

In the instant embodiment of the present invention, the boost converter 210 comprises: an inductor L, a rectifier diode D and a MOS transistor Q4.

One end of the inductor L is for receiving input DC voltage Vin, and the other end is connected to the positive terminal of the rectifier diode D and the drain of the MOS transistor Q4. The gate of the MOS transistor Q4 is connected to the backlight driving IC 220. The negative terminal of the rectifier diode D is connected to the positive terminals of the plurality of the LEDs of each LED string.

To ensure the overall LED backlight has sufficient power to satisfy the N parallel LED strings, A1, A2, . . . , An, a fifth resistor R5 is further included, wherein the source of the MOS transistor Q4 is connected to one end of the fifth resistor R5 and the other end of the fifth resistor R5 is grounded.

When the backlight driving IC 220 outputs a high voltage level signal to the gate of the MOS transistor Q4, the MOS transistor Q4 is conductive, the inductor L stores energy. On the other hand, when the backlight driving IC 220 outputs a low voltage level signal to the gate of the MOS transistor Q4, the MOS transistor Q4 is shutdown, the inductor L releases energy. Through controlling the MOS transistor Q4 as shutdown or conductive, the backlight driving IC 220 makes the boost converter 210 operate so that the boost converter 210 boosts the input DC voltage Vin and outputs the boosted DC voltage to each LED string.

In the instant embodiment, the open detection unit 231 comprises an operational amplifier OP1 and the open trigger protection unit 232 comprises a MOS transistor Q2 and a backup circuit 233.

The operational amplifier OP1 has a negative terminal connected to one end of the MOS transistor Q1, a positive terminal grounded and an output terminal connected to the gate of the MOS transistor Q2; the source of the MOS transistor Q2 is connected to the drain of the MOS transistor Q1; one end of the backup circuit 233 is connected to the positive terminals of the plurality of LEDs in each LED string and the other end of the backup circuit 233 is connected to the drain of the MOS transistor Q2.

Furthermore, in the instant embodiment, the backup circuit 233 further comprises a second resistor R2, a third resistor R3, a fourth resistor R4, wherein the second, third and fourth resistors R2, R3, R4 are connected in parallel. One end of the second resistor R2 is connected to the positive terminals of the plurality of LEDs of each LED string and the other end of the second resistor R2 is connected to the drain of the MOS transistor Q2. In this instant embodiment, the backup circuit 233 comprises three resistors connected in parallel, which is for effectively dividing the current flowing through the backup circuit 233 to avoid damage caused by over-current. It should be noted that the backup circuit 233 can also comprises only one resistor with a resistance satisfying the requirement of the circuit. Similarly, the backup circuit 233 can also comprises two resistors or other number of resistors connected in parallel.

The following uses the first LED string A1 as exemplar to describe the specific functions of the corresponding control circuit 230. It should be noted that the description also applies to the functions of other control circuit 230 on corresponding LED strings.

When the first LED string A1 operate normally to emit light, the current flowing through the first LED string A1 is normal, and thus the current flowing through the first resistor R1 is also normal so that the voltage over the two ends of the first resistor R1 is not zero. At this point, the voltage at the positive terminal of the operational amplifier OP1 is zero and the voltage at the negative terminal of the operational amplifier OP1 is not zero. The operational amplifier OP1 outputs a low voltage level to the gate of MOS transistor Q2 to shut down the MOS transistor Q2. As a result, the corresponding control circuit 230 has no effect.

However, when the first LED string A1 becomes open, the current flowing through the first LED string A1 becomes zero, and thus the current flowing through the first resistor R1 is also zero so that the voltage over the two ends of the first resistor R1 is zero. At this point, in the control circuit 230 corresponding to the first LED string A1, the voltage at the positive terminal of the operational amplifier OP1 and the voltage at the negative terminal of the operational amplifier OP1 are both zero, and the output of the operational amplifier OP1 is inverted and outputs high voltage level to the gate of MOS transistor Q2 to make the MOS transistor Q2 conductive. As such, the boosted DC voltage from the boost converter 210, after divided by the parallel second, third and fourth resistors R2, R3 and R4, is applied to the first resistor R1, the same as the voltage applied when the first LED string A1 operates normally. The backlight driving IC 220 detects the voltage over the two ends of first resistor R1 the same as the voltage applied when the first LED string A1 operates normally, and the backlight driving IC 210 will not control to shut down the remaining LED strings other than the first LED string A1. As a result, the remaining LED strings will provide light normally, and only the first LED string A1 does not emit light.

Second Embodiment

In the second embodiment, only the part that is different from the first embodiment will be described to avoid repetition.

Figure 3:
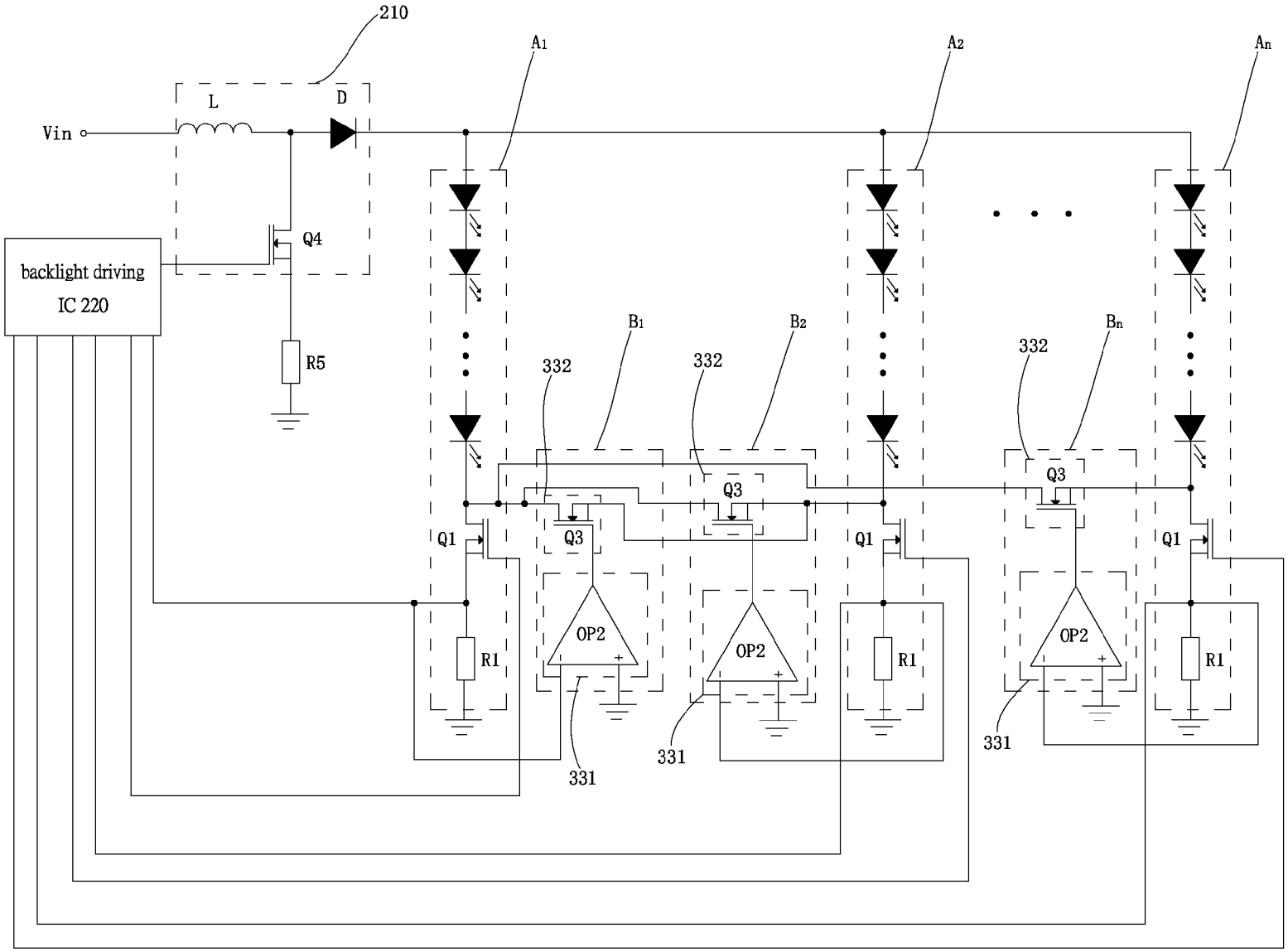
FIG. 3 is a schematic view showing the LED backlight source of liquid crystal display device according to the second embodiment of the present invention.

FIG. 3 is a schematic view showing the LED backlight source of liquid crystal display device according to the second embodiment of the present invention.

As shown in FIG. 3, in the instant embodiment, the open detection unit of the control circuit comprises an operational amplifier OP2 and the open trigger protection unit 232 comprises a MOS transistor Q3.

In the control circuit, the operational amplifier OP2 has a positive terminal grounded and an output terminal connected to the gate of the MOS transistor Q3, and the drain of the MOS transistor Q3 is connected to the drain of the MOS transistor Q1 of the first LED string.

In the first control circuit B1, the negative terminal of the operational terminal OP2 is connected to the source of the MOS transistor Q1 of the first LED string A1, the source of the MOS transistor Q3 is connected to the drain of the MOS transistor Q1 of the second LED string A2.

In the second control circuit B2 to N-th control circuit Bn, the negative terminal of the operational amplifier OP2 is connected respectively to the source of the MOS transistor Q1 of the second LED string A2 to N-th LED string An. The source of the MOS transistor Q3 is connected respectively to the drain of the MOS transistor Q1 of the second LED string A2 to N-th LED string An.

The following uses the first LED string A1 and second LED string A1 as exemplar to describe the specific functions of the corresponding first control circuit B1 and second control circuit B2. It should be noted that the description of the second control circuit B2 also applies to the functions of third control circuit B3 to N-th control Bn.

When the first LED string A1 operate normally to emit light, the current flowing through the first LED string A1 is normal, and thus the current flowing through the first resistor R1 is also normal so that the voltage over the two ends of the first resistor R1 is not zero. At this point, the voltage at the positive terminal of the operational amplifier OP2 is zero and the voltage at the negative terminal of the operational amplifier OP2 is not zero. The operational amplifier OP2 outputs a low voltage level to the gate of MOS transistor Q3 to shut down the MOS transistor Q3. As a result, the corresponding first control circuit B1 has no effect.

However, when the first LED string A1 becomes open, the current flowing through the first LED string A1 becomes zero, and thus the current flowing through the first resistor R1 is also zero so that the voltage over the two ends of the first resistor R1 is zero. At this point, in the first control circuit B1 corresponding to the first LED string A1, the voltage at the positive terminal of the operational amplifier OP2 and the voltage at the negative terminal of the operational amplifier OP2 are both zero, and the output of the operational amplifier OP2 is inverted and outputs high voltage level to the gate of MOS transistor Q3 to make the MOS transistor Q3 conductive. As such, a current divided from the second LED string A2 flow through the first resistor R1, the same as the current flow through the first resistor R1 when the first LED string A1 operates normally. The backlight driving IC 220 detects the voltage over the two ends of first resistor R1 the same as the voltage when the first LED string A1 operates normally, and the backlight driving IC 210 will not control to shut down the remaining LED strings other than the first LED string A1. As a result, the remaining LED strings, i.e., A2, A3, . . . , An, will provide light normally, and only the first LED string A1 does not emit light.

For the second LED string A2, when the second LED string A2 operate normally to emit light, the current flowing through the second LED string A2 is normal, and thus the current flowing through the first resistor R1 of the second LED string A2 is also normal so that the voltage over the two ends of the first resistor R1 is not zero. At this point, the voltage at the positive terminal of the operational amplifier OP2 is zero and the voltage at the negative terminal of the operational amplifier OP2 is not zero. The operational amplifier OP2 outputs a low voltage level to the gate of MOS transistor Q3 to shut down the MOS transistor Q3. As a result, the corresponding second control circuit B2 has no effect.

However, when the second LED string A2 becomes open, the current flowing through the second LED string A2 becomes zero, and thus the current flowing through the first resistor R1 of the second LED string A2 is also zero so that the voltage over the two ends of the first resistor R1 is zero. At this point, in the second control circuit B2 corresponding to the second LED string A2, the voltage at the positive terminal of the operational amplifier OP2 and the voltage at the negative terminal of the operational amplifier OP2 are both zero, and the output of the operational amplifier OP2 is inverted and outputs high voltage level to the gate of MOS transistor Q3 to make the MOS transistor Q3 conductive. As such, a current divided from the first LED string A1 flow through the first resistor R1 of the second LED string A2, the same as the current flow through the first resistor R1 when the second LED string A2 operates normally. The backlight driving IC 220 detects the voltage over the two ends of first resistor R1 the same as the voltage when the second LED string A2 operates normally, and the backlight driving IC 210 will not control to shut down the remaining LED strings other than the second LED string A2. As a result, the remaining LED strings will provide light normally, and only the second LED string A2 does not emit light.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An LED backlight source, applicable to liquid crystal display device, which comprises:

a boost converter, for boosting an input DC voltage and outputting boosted DC voltage;

N LED strings connected in parallel, wherein each LED string comprising a plurality of LEDs strung in series and receiving the boosted DC voltage from the boost converter, N being a natural number;

a backlight driving IC, for controlling the connection/disconnection of the boost converter, and determining whether to shut down the LED strings other than a specific LED string based on the voltage at the negative terminal of the specific LED string; and N control circuits, wherein each control circuit controlling the voltage at negative terminal of a corresponding LED stringy not to become zero so that the backlight driving IC unable to shut down LED strings other than the corresponding LED string;

wherein the control circuit further comprises:

an open detection unit, for detecting whether a corresponding LED string being open; and an open trigger protection unit, for controlling the negative terminal of a corresponding LED string not to become zero when the open detection unit detecting the corresponding LED string being open.

2. The LED backlight source as claimed in claim 1, wherein the negative terminals of the plurality of LED strings are connected to the drain of a first MOS transistor and connected to the open trigger protection unit, the source of the first MOS transistor is connected to one end of a first resistor and connected to the backlight driving IC, one end of the first resistor is connected to the open detection unit and the other end of the first resistor is ground, and the gate of the first MOS transistor is connected to the backlight driving IC.

3. The LED backlight source as claimed in claim 2, wherein the open detection unit comprises a first operational amplifier, the open trigger protection unit comprises a second MOS transistor and a backup circuit;

wherein the first operational amplifier has a negative terminal connected to one end of the first resistor, a positive terminal grounded and an output terminal connected to the gate of the second MOS transistor; the source of the second MOS transistor is connected to the drain of the first MOS transistor; one end of the backup circuit is connected to the positive terminals of the plurality of LED strings and the other end of the backup circuit is connected to the drain of the second MOS transistor.

4. The LED backlight source as claimed in claim 3, wherein the backup circuit comprises a resistor, wherein one end of the resistor is connected to the positive terminals of the plurality of LED strings and the other end of the resistor is connected to the drain of the second MOS transistor.

5. The LED backlight source as claimed in claim 3, wherein the backup circuit comprises at least two resistors, wherein one end of each resistor is connected to the positive terminals of the plurality of LED strings and the other end of each resistor is connected to the drain of the second MOS transistor.

6. The LED backlight source as claimed in claim 2, wherein the open detection unit comprises a second operational amplifier and the open trigger protection unit comprises a third MOS transistor;

wherein in each control circuit, the second operational amplifier has a positive terminal grounded and an output terminal connected to the gate of the third MOS transistor; the source of the third MOS transistor is connected to the drain of the first MOS transistor of the first LED string;

in the first control circuit, the negative terminal of the second operational amplifier is connected to the source of the first MOS transistor of the first LED string, the source of the third MOS transistor is connected to the drain of the first MOS transistor of the second LED string; and in the second to N-th control circuits, the negative terminal of the second operational amplifier is connected respectively to the source of the first MOS transistor of the second to N-th LED string, the source of the third MOS transistor is connected respectively to the drain of the first MOS transistor of the second to N-th LED string.

7. The LED backlight source as claimed in claim 2, wherein the boost converter comprises an inductor, a rectifier diode and a fourth MOS transistor;

wherein one end of the inductor is connected to the input DC voltage and the other end of the inductor is connected to the drain of the fourth MOS transistor; the gate of the fourth MOS transistor is connected to the backlight driving IC; and the negative terminal of the rectifier diode is connected to the positive terminals of the plurality of LED strings.

8. The LED backlight source as claimed in claim 7, wherein the LED backlight source further comprises a fifth resistor, with one end connected to the source of the fourth MOS transistor and the other end grounded.

9. A liquid crystal display device, which comprises: a liquid crystal display panel and an LED backlight source disposed opposite to the liquid crystal display panel, the LED backlight source providing display light source to the liquid crystal display panel for the liquid crystal panel to display images, wherein the LED backlight source further comprising:

a boost converter, for boosting an input DC voltage and outputting boosted DC voltage;

N LED strings connected in parallel, wherein each LED string comprising a plurality of LEDs strung in series and receiving the boosted DC voltage from the boost converter, N being a natural number;

a backlight driving IC, for controlling the connection/disconnection of the boost converter, and determining whether to shut down the LED strings other than a specific LED string based on the voltage at the negative terminal of the specific LED string; and N control circuits, wherein each control circuit controlling the voltage at negative terminal of a corresponding LED string not to become zero so that the backlight driving IC unable to shut down LED strings other than the corresponding LED string;

wherein the control circuit further comprises:

an open detection unit, for detecting whether a corresponding LED string being open; and an open trigger protection unit, for controlling the negative terminal of a corresponding LED string not to become zero when the open detection unit detecting the corresponding LED string being open.

10. The liquid crystal display device as claimed in claim 9, wherein the negative terminals of the plurality of LED strings are connected to the drain of a first MOS transistor and connected to the open trigger protection unit, the source of the first MOS transistor is connected to one end of a first resistor and connected to the backlight driving IC, one end of the first resistor is connected to the open detection unit and the other end of the first resistor is ground, and the gate of the first MOS transistor is connected to the backlight driving IC.

11. The liquid crystal display device as claimed in claim 10, wherein the open detection unit comprises a first operational amplifier, the open trigger protection unit comprises a second MOS transistor and a backup circuit;

wherein the first operational amplifier has a negative terminal connected to one end of the first resistor, a positive terminal grounded and an output terminal connected to the gate of the second MOS transistor; the source of the second MOS transistor is connected to the drain of the first MOS transistor; one end of the backup circuit is connected to the positive terminals of the plurality of LED strings and the other end of the backup circuit is connected to the drain of the second MOS transistor.

12. The liquid crystal display device as claimed in claim 11, wherein the backup circuit comprises a resistor, wherein one end of the resistor is connected to the positive terminals of the plurality of LED strings and the other end of the resistor is connected to the drain of the second MOS transistor.

13. The liquid crystal display device as claimed in claim 11, wherein the backup circuit comprises at least two resistors, wherein one end of each resistor is connected to the positive terminals of the plurality of LED strings and the other end of each resistor is connected to the drain of the second MOS transistor.

14. The liquid crystal display device as claimed in claim 10, wherein the open detection unit comprises a second operational amplifier and the open trigger protection unit comprises a third MOS transistor;

wherein in each control circuit, the second operational amplifier has a positive terminal grounded and an output terminal connected to the gate of the third MOS transistor; the source of the third MOS transistor is connected to the drain of the first MOS transistor of the first LED string;

in the first control circuit, the negative terminal of the second operational amplifier is connected to the source of the first MOS transistor of the first LED string, the source of the third MOS transistor is connected to the drain of the first MOS transistor of the second LED string; and in the second to N-th control circuits, the negative terminal of the second operational amplifier is connected respectively to the source of the first MOS transistor of the second to N-th LED string, the source of the third MOS transistor is connected respectively to the drain of the first MOS transistor of the second to N-th LED string.

15. The liquid crystal display device as claimed in claim 10, wherein the boost converter comprises an inductor, a rectifier diode and a fourth MOS transistor;

wherein one end of the inductor is connected to the input DC voltage and the other end of the inductor is connected to the drain of the fourth MOS transistor; the gate of the fourth MOS transistor is connected to the backlight driving IC; and the negative terminal of the rectifier diode is connected to the positive terminals of the plurality of LED strings.

16. The liquid crystal display device as claimed in claim 15, wherein the LED backlight source further comprises a fifth resistor, with one end connected to the source of the fourth MOS transistor and the other end grounded.

* * * * *